US005759096A

United States Patent [19]

Berlin et al.

[11] Patent Number: 5,759,096

[45] Date of Patent: Jun. 2, 1998

[54] TRIMODAL AIR/FLUID DRIVEN SASH OPERATOR FUME HOOD

[75] Inventors: Robert M. Berlin, Linwood; Warren L. Zeigler, Midland, both of Mich.

[73] Assignee: Zeigler Enterprises, Inc., Midland, Mich.

[21] Appl. No.: 855,016

[22] Filed: May 13, 1997

[51] Int. Cl.[6] ..... B08B 15/02

[52] U.S. Cl. ..... 454/56; 49/447

[58] Field of Search ..... 454/56; 49/200, 49/445, 447

[56] References Cited

U.S. PATENT DOCUMENTS 3,820,446 6/1974 Granbom et al. .
3,934,496 1/1976 Turko .
4,150,606 4/1979 Nelson .
4,377,969 3/1983 Nelson .
4,502,375 3/1985 Zeigler et al. .
4,548,128 10/1985 Morikawa et al. .
4,774,878 10/1988 Berlin et al. .
5,148,631 9/1992 Bayard et al. ..... 49/449

*Primary Examiner*—Harold Joyce
*Attorney, Agent, or Firm*—Robert L. McKellar

[57] ABSTRACT

A fume hood sash operator and fume hoods containing such sash operators. The sash operator is constructed to operate from a pressure fluid cylinder which has no outside operating parts with respect to the movement of the piston in the cylinder. The unique construction of the pressure fluid cylinder makes it very useful for fume hood construction because of the overall small dimensions of the pressure fluid cylinder and the ability to start the piston by overcoming the inertia of the piston using very low air or fluid pressures.

7 Claims, 6 Drawing Sheets

Fig. 2
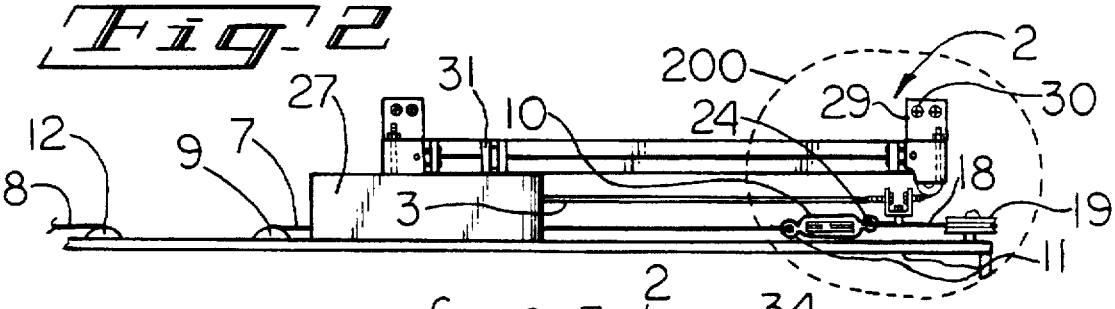
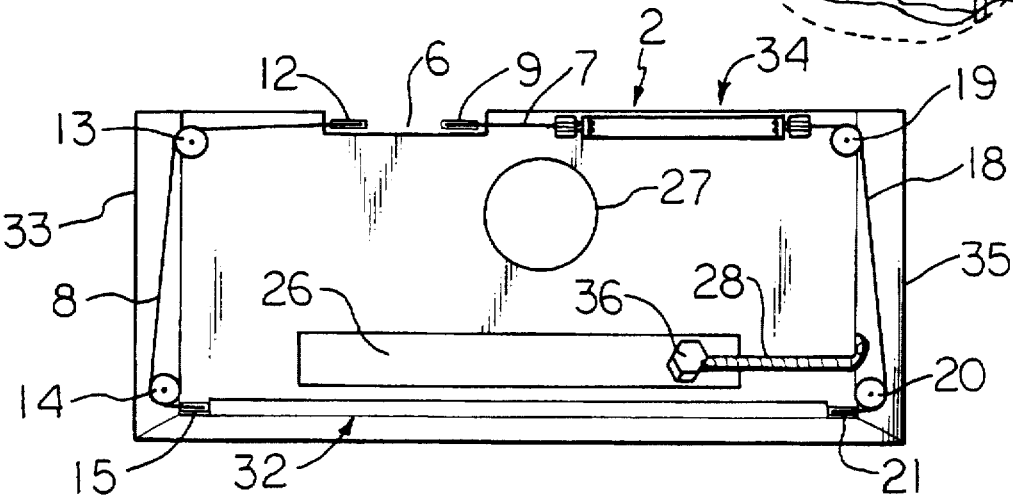
Fig. 3
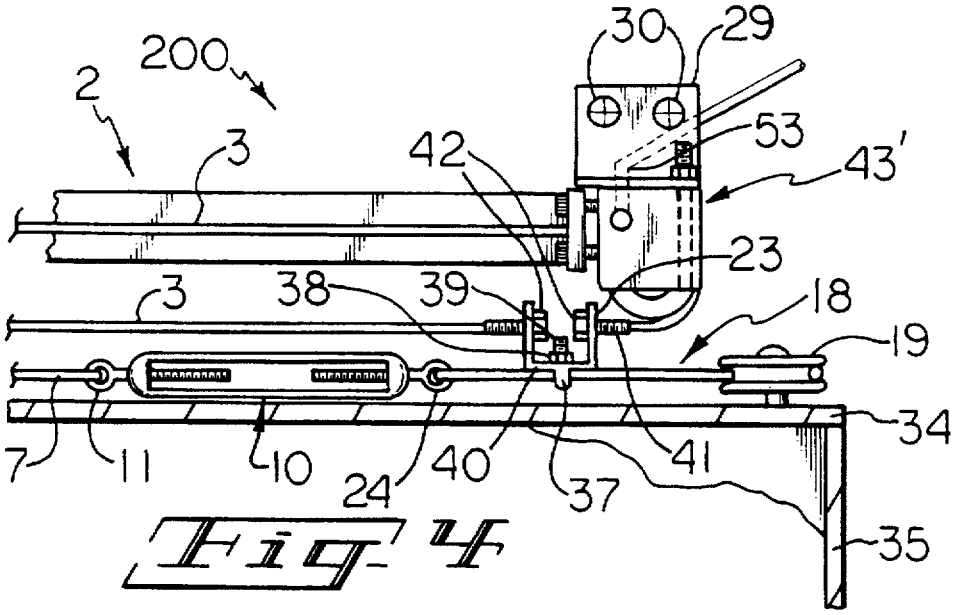
Fig. 4

TRIMODAL AIR/FLUID DRIVEN SASH OPERATOR FUME HOOD

This invention deals with a trimodal pressure fluid driven sash operator for fume hoods and fume hoods so equipped. Fume hoods are a common item of most every chemical laboratory and have been employed in one form or another for many years. As new materials and techniques are evolved, the fume hood undergoes modifications to attempt to ensure the working personnel freedom from spills and burns, noxious gases and chemicals. In recent years, this concern for safety has been coupled with a concern for energy conservation and certain modifications were made in standard fume hoods to ensure some energy savings while retaining the safety aspects of such hoods. For example, the air intake and exhaust ducts were adapted to electrical or pneumatic dampers or adjustable speed motors which would work to adjust motor speeds or duct openings in order to utilize only the mass of air that was required for safety purposes while not allowing large volumes of air to continuously pass through the fume hood and cause a waste of energy.

This invention deals with a modified pressure fluid cylinder that is adaptable to fume hood construction because it lends itself to fume hood arrangements that require small spaces. This is so because the pressure cylinder used in this invention has a unique construction that requires less space than the pressure fluid cylinders currently used in the art.

BACKGROUND OF THE INVENTION

The prior art known to the applicant is set forth in U.S. Pat. No. 3,934,496 to Turko, which issued on Jan. 27, 1976 in which there is shown a counterbalance mechanism for fume hoods, which is the counter weight concept for modern fume hoods. Shown in U.S. Pat. No. 4,150,606 to Nelson, which issued on Apr. 24, 1979 is the use of an automatic fume hood sash operator which is electrically coupled with an automatic switch mechanism, such as a rubber floor switch mat, or a photoelectric eye. The invention therein appears to be a sash operator which is actuated by a continuous cable loop carrying an activator switch which contacts limit switches which are built into the line of travel of the activator switch. A moveable sash member of the hood structure is raised or lowered in correspondence to the movement of the activator switch. No provision seems to be made in the Nelson invention for control of the sash member using a pressure fluid cylinder.

A second patent to Nelson is U.S. Pat. No. 4,377,969, which issued Mar. 29, 1983. This device is manually operated and thus has no motor or cylinder for movement of the sash.

A recent patent wherein the inventor herein is one of the named inventors is U.S. Pat. No. 4,502,375, which issued Mar. 5, 1985, which shows a fume hood sash operator which is controlled by a belt drive and a clutch mechanism so that the sash member can be stopped, started, moved up or down to accommodate changes in the flow of air moving through the hood structure.

Yet another patent, U.S. Pat. No. 4,548,128, which issued on Oct. 22, 1985 to Morikawa, et al. shows a fume hood which includes a sensor for detecting an air speed within the exhaust duct to provide control over the volume of air that is moved through the fume hood.

A most recent patent which issued on Oct. 4, 1988 to Berlin, et al, namely, U.S. Pat. No. 4,774,878, shows a fume hood having a piston driven means for controlling the movement of a sash in the opening. This patent deals with a pressure fluid cylinder which is mounted on the fume hood structure and assists in the movement of the sash within the opening when used in conjunction with a counter weight.

The pressure fluid cylinder used in that invention and disclosed in the patent is itself patented and a description of that cylinder can be found in U.S. Pat. No. 3,820,446 which issued to Granbom, et al., on Jun. 28, 1974. A Swedish patent describing essentially the same device is No. 326 376, published on Jul. 20, 1970.

This pressure fluid cylinder has a design which includes a slot extending longitudinally along its cylinder wall and there is a piston provided with a projection extending through said slot and slidable along the slot in concert with the piston. The projection is coupled to a drive bracket and a cable which is attached to a drive means for the purposes of movement of the drive means, which moves the sash operator and the counter-balancing weights used therein. The design of the pressure fluid cylinder provides a stroke which requires additional length to the cylinder as compared to the pressure fluid cylinder of the instant invention, and thus, makes it unattractive for use in fume hoods requiring small spaces for installation. Further, the pressure fluid cylinder of this invention allows for the use of very low pressures to overcome inertia, on the order of about 2 to 3 Psi, while the prior art cylinders requires at least 3 to 5 Psi in order to overcome inertia.

BRIEF SUMMARY OF THE INVENTION

The instant invention is directed to a new and improved means of driving a sash member in an access opening of a fume hood. The fume hood may be moved into closed or partially closed position and opened or partially opened position. In addition, the instant invention deals in part with a means of protecting operating personnel since a means for interrupting the movement of the sash member in the access opening at any point in the cycle of opening and closing of the sash, is provided.

The instant invention also includes a fume hood into which the drive means is incorporated since the use of the inventive drive means in a fume hood allows for new and novel functions for such a fume hood.

The inventive drive means is adaptable to almost any hood system of almost any design and even though it is primarily designed for newer, more modern designs of fume hoods, the instant invention can be readily adapted to existing hood structures.

Some of the newer hoods in use today have such features as occupying small spaces and such limitations must be incorporated into the design of the fume hoods owing to the very limited space that the drive means of the instant invention needs to occupy.

BRIEF DESCRIPTION OF THE DRAWINGS

FIG. 2 is a cut-a-way view of section 100 of FIG. 1, showing the back, upper right hand corner of the fume hood and the pressure fluid cylinder mounted horizontally on the fume hood, wherein R in FIG. 1 designates the right hand side of the fume hood. This Figure shows the detail of one desirable location for mounting the drive means of this invention.

FIG. 3 is a top view of FIG. 1 and coincides in part with the view of FIG. 2.

FIG. 4 is an enlarged view of segment 200 of FIG. 2 and shows the intimate detail of the adjusting means 10, the drive cable 3, and the housing of the drive means, along with the connection of the drive cable to the drive bracket and the connection of the drive bracket to a sash drive cable.

THE INVENTION

Figure 1:
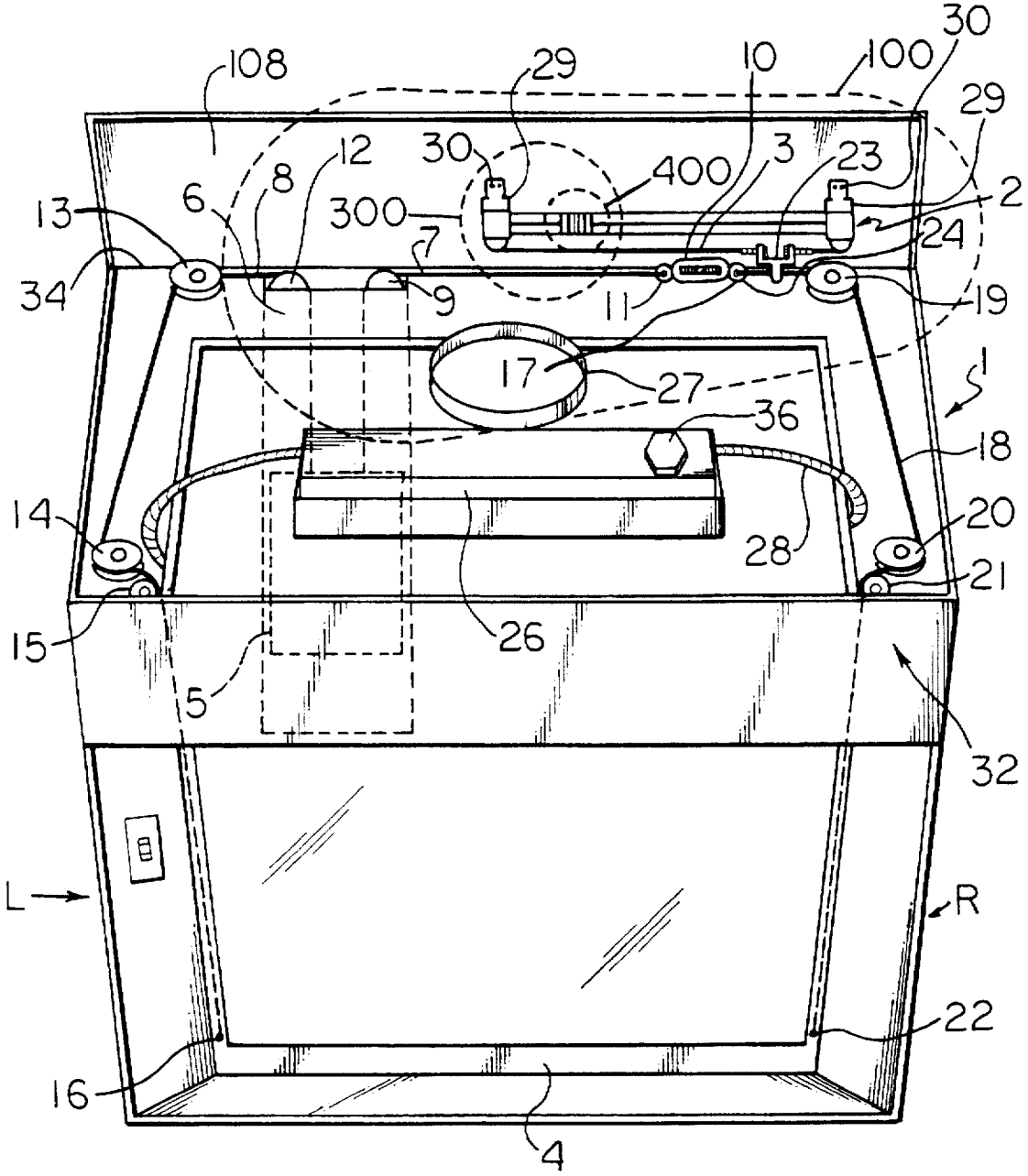
FIG. 1 is a top frontal view in perspective of a fume hood of this invention showing one possible configuration for the use of drive cables and idler cables.

What is disclosed and claimed herein is a trimodal piston driven sash operator for a fume hood structure and fume hoods so equipped. The fume hood structure has an access opening in one wall and a closure structure including a moveable sash member disposed for movement in the opening to vary the effective size of the opening thereof. The sash operator comprises a power source, a drive means driven by the power source wherein the drive means is mounted on a stationary portion of the fume hood structure. The drive means is a pressure fluid cylinder, wherein the pressure fluid cylinder comprises in combination a pair of housings, one housing being a near end housing and the other housing being a distal end housing, each of said housings having a front wall, a bottom wall, a top wall, two side walls and a back wall.

An elongated cylinder having a distal end, a near end, and a long centered axis and an inside surface, bridges the housings and each of the cylinder near end and distal end is sealed respectively in each of the housings.

There is a slidable piston located in the cylinder, the piston having an outside surface and a centered axis parallel with the long centered axis of the cylinder. There is a first drive cable, wherein the first drive cable is attached to the near end of the piston and at its center axis, wherein the first drive cable extends along the center axis of the cylinder and extends to and through an opening located in the front surface of the near end housing.

There is a freely rotatable first housing pulley having a circumferential outside surface, said first housing pulley being mounted on a round axle, the axle being supported on each of its ends by a housing side wall. The first drive cable extends along the groove of the first pulley and around essentially one half of the circumferential outside surface thereof and extends outside and along the length of the cylinder and connects with a common drive bracket. There is a second drive cable, the second drive cable being attached to the distal end of the piston and at its center axis and extending along the center axis of the cylinder and extending to and through an opening located in the front surface of the distal end housing.

There is a freely rotatable second pulley having a circumferential outside surface, said second pulley being mounted on a round axle, said axle being supported on each of its ends by a housing side wall. The second drive cable extends along the groove of the second pulley and around essentially one-half of the circumferential outside surface thereof. The second drive cable extends outside and along the length of the cylinder and connects with the common drive bracket.

Each of the openings in the front surfaces of the housings are sealed around each of the cables extending through them. Each of the housings has a second opening in the respective front walls thereof, each opening being in communication with a passageway in the housing to allow for the entry of air or fluid to pressure the piston in the cylinder. The entry of air or fluid is controlled by a control device that is normally used in pneumatic or fluid drive systems.

The piston has at least one sealing ring centered around its outside surface to provide a seal between the piston and the inside surface of the cylinder and the piston is slidable along the cylinder when the drive means is activated from the power source.

The common drive bracket is attached to the drive means by suitable means and said common drive bracket is detachedly fixed to a weight structure within the hood and can be directly attached to the weight structure, or can be attached via cables, all of which is set forth in detail infra.

There is a means of controlling the power source to control the movement of the weighted structure, to control movement of the moveable sash member in the access opening.

This invention also contemplates conventional configurations for the cables and pulleys in conjunction with the invention described Supra.

Finally, there is an embodiment of this invention which features a chain driven mechanism which includes a first cable being attached to the near end of the piston and at its center axis, and as above, the first cable extends along the center axis of the cylinder and extends to and through an opening located in the front surface of the near end housing.

There is a freely rotatable first pulley having a circumferential outside surface, the first pulley being mounted on a round axle, said axle being supported on each of its ends by a housing side wall.

The first cable extends along the bottom of the first pulley and around essentially one half of the circumferential outside surface thereof, said first cable extending outside and along the length of the cylinder and connecting with a common drive bracket.

There is a second cable, the second cable is attached to the distal end of the piston and at its center axis and extending along the center axis of the cylinder and extending to and through an opening located in the front surface of the distal end housing.

There is a freely rotatable second pulley having a circumferential outside surface, said second pulley being mounted on a round axle, said axle being supported on each of its ends by a housing side wall.

The second cable extends along the second pulley and around essentially one-half of the circumferential outside surface thereof, the cable extends outside and along the length of the cylinder and connecting with the common drive bracket.

Each of the openings in the front surfaces of the housings is sealed around each of the cables extending through them and each of the housings have second openings in the respective front walls thereof, each opening being in communication with a passageway in the housing to allow for the entry of air to pressure the piston in the cylinder.

The piston has at least one sealing ring centered around its outside surface to provide an air seal between the piston and the inside surface of the cylinder, the piston being slidable along the cylinder when the drive means is activated from the power source.

There is a common drive bracket attached to the drive means by suitable means and said common drive bracket being directly, detachedly fixed to a common weight structure within the hood.

There is a freely rotatable first drive axle having a near end and a distal end, said first drive axle being mounted on the top of the fume hood structure and near and parallel with the top rail of the moveable sash member, there being a freely rotatable second drive axle having a near end and a distal end and being mounted on the top of the fume hood structure and distal to the moveable sash member and near the back of the fume hood structure, said second drive axle being aligned essentially parallel with the first drive axle.

There is a first driveable chain attached to the moveable sash member at or near the bottom rail and extending from the moveable sash member to a first chain sprocket, said first chain sprocket being mounted on the near end of the first drive axle, said first drive chain extending over the first chain sprocket and extending to and around the outside of a second chain sprocket, the second chain sprocket being mounted on the near end of the freely rotatable second drive axle, said first chain passing to the common weight structure and being detachedly fixed thereto.

There is a second driveable chain attached to the moveable sash member at or near the bottom rail and extending from the moveable sash member to a third chain sprocket, said third chain sprocket being mounted on the distal end of the first drive axle, said second drive chain extending from the bottom rail of the moveable sash member and over the third chain sprocket, extending to and around the outside of a fourth chain sprocket, said fourth chain sprocket being mounted on the distal end of the freely rotatable second drive axle, said second chain passing to the common weight structure and being detachedly fixed thereto.

There is a means of controlling the power source to control the movement of the weighted structure, to control movement of the moveable sash member in the access opening.

DETAILED DESCRIPTION OF THE INVENTION

Turning now to FIG. 1, there is shown a top frontal view in perspective of the top half (the conventional support unit for the fume hood 1 is not shown for clarity) of a fume hood 1 of this invention showing one embodiment thereof wherein there is indicated the back 34 of the fume hood 1 and there is shown the back horizontal placement of a pressure fluid cylinder 2 and the drive cable 3 connected thereto as a drive means. Also shown is the moveable sash member 4, which is movably mounted in the front 32 of the fume hood 1 and which for purposes of illustration shows the moveable sash member 4 in the closed position. There is also shown a conventional light fixture 26, duct collar 27, and the electrical cable 28 and electrical junction box 36 for the light fixture 26. Shown for purposes of clarity is an upward extension of a flat back panel 108 for the fume hood 1, to which the mounting brackets 29 are attached. The mounting brackets 29 are used to fix the pressure fluid cylinder 2 to the fume hood 1 by the use of fastening means 30.

A back mounted dropping dead weight 5 (weighted structure) is shown in phantom in dead weight channel 6, also shown in phantom. Connected to the dropping dead weight 5 at or near the top thereof, are two cables 7 and 8. In one configuration, the first of the cables 7 leads from the dropping dead weight 5 to a horizontally mounted, dead weight first back pulley 9, the cable 7 extending up and over the horizontally mounted, dead weight first back pulley 9 to a turnbuckle 10 where it is detachedly fixed to a ring 11 of the turnbuckle 10.

The other cable, 8, extends upwardly over a horizontally mounted, dead weight second back pulley 12, extending up and over the horizontally mounted, dead weight second back pulley 12 to a left back cable pulley 13 that is vertically mounted on fume hood 1. The terms "L" and "R" mean "left" and "right" as used herein and are for illustration purposes only, and are intended to make reference to the fume hood 1 from the front wherein "left" (L) means the left side or idle side wall of the fume hood 1, and "right" (R) means the right side or drive side wall of the fume hood when viewed from this frontal position.

The cable 8 then extends around the outside of the vertically mounted, left back cable pulley 13, to yet another pulley 14 which is vertically mounted at the front of the fume hood 1, the cable 8 extending around the outside of the vertically mounted, left front cable pulley 14 and extending to yet another horizontally mounted, left front cable pulley 15, which carries the cable 8 downwardly to an attachment point 16 at the base of the moveable sash member 4.

Returning to the drive means for this invention and with continuing reference to FIG. 1, attached to the opposite end 17 of the turnbuckle 10 is an adjustable ring 24 to which is attached yet another cable 18, which is a sash cable. Sash cable 18 extends to a vertically mounted, right back cable pulley 19, the sash cable 18 extending frontwardly to yet another pulley 20, which is vertically mounted on the right front of the fume hood 1, wherein the sash cable 18 extends around the outside of the vertically mounted, right front cable pulley 20, extends to a right front pulley 21 which is horizontally mounted on the fume hood 1, wherein the sash cable 18 extends downwardly around the outside of the horizontally mounted, right front pulley 21 and extends to an attachment point 22.

The sash cable 18 is detachedly attached to a cable bracket 23 at a point between the turnbuckle ring 24 and the vertical pulley 19. Attached to the cable bracket 23 is the drive cable 3.

When the pressure fluid cylinder 2 is activated, the drive cable 3 is activated, whereby the cables 7 and 18 are activated. The activation of the cable 7 activates the dropping dead weight 5, which in turn activates the sash cable 8 whereby the action of sash cable 8 and cable 18 raise or lower the moveable sash member 4.

For a better appreciation of this embodiment of the invention, reference is made to FIG. 2, in which there is shown a blown-up front view of a section 100 of FIG. 1, of the pressure fluid cylinder 2 and its connection with the top half of the fume hood 1.

There is therefore shown moving essentially from left to right in FIG. 2, the cable 8, horizontally mounted dead weight pulley 12, horizontally mounted dead weight pulley 9, cable 7, duct collar 27, drive cable 3, turnbuckle ring 11, fastening means 30, mounting bracket 29, sash cable 18, vertically mounted back cable pulley 19, turnbuckle ring 24, and turnbuckle 10, with 1 denoting the fume hood, wherein there is also shown the piston 31 of the pressure fluid cylinder 2, which will be shown in greater detail in FIG. 4 and discussed infra.

Turning to FIG. 3, there is shown a reduced full top view of the fume hood 1 of FIG. 1, in which there is shown moving essentially in a clockwise motion around the Figure, the front 32 of the fume hood 1, horizontally mounted front cable pulley 15, vertically mounted front cable pulley 14, left side of the fume hood 33, cable 8, vertically mounted back cable pulley 13, horizontally mounted dead weight pulley 12, the dead weight channel 6, horizontally mounted dead weight pulley 9, cable 7, pressure fluid cylinder 2, back wall 34 of the fume hood 1, vertically mounted back cable pulley 19, sash cable 18, right wall 35 of the fume hood 1, vertically mounted front cable pulley 20, horizontally mounted front cable pulley 21, electrical cable 28, electrical junction box 36, and light fixture 26.

Turning now to FIG. 4, there is shown therein a section 200 of FIG. 2 showing one means of connecting the drive cable 3 to the sash cable 18.

The connecting means for connecting the drive cable 3 to the sash cable 18 comprises the U-shaped cable bracket 23 fitted with a U-bolt 37, which carries the sash cable 18 through it and in which the bottom of the U-bolt 37 clamps around the sash cable 18. When the U-bolt 37 is equipped with a nut 38 and the nut 38 is drawn down on the threads 39 of the U-bolt, causing the sash cable 18 to be drawn against the bottom 40 of the cable bracket 23 the sash cable 18 is securely clamped to the cable bracket 23.

In addition, either side of the U-shaped cable bracket 23 is fitted with threaded rods 41, which fitted rods 41 are securely fastened to the inside wall of the U-shaped bracket 23. The threaded rods 41 are fitted with means (not shown) which secure the drive cable 3 to the threaded rods 41. The ends of the threaded rods 41 that are opposite to the drive cable 3 securement, are each fitted with a threaded nut 42, which when tightened on the threaded rods 41, draw the drive cable 3 tight. Thus, when the drive cable 3 is activated by the pressure fluid cylinder 2, the sash cable 18 is drawn simultaneously therewith.

Figure 5:
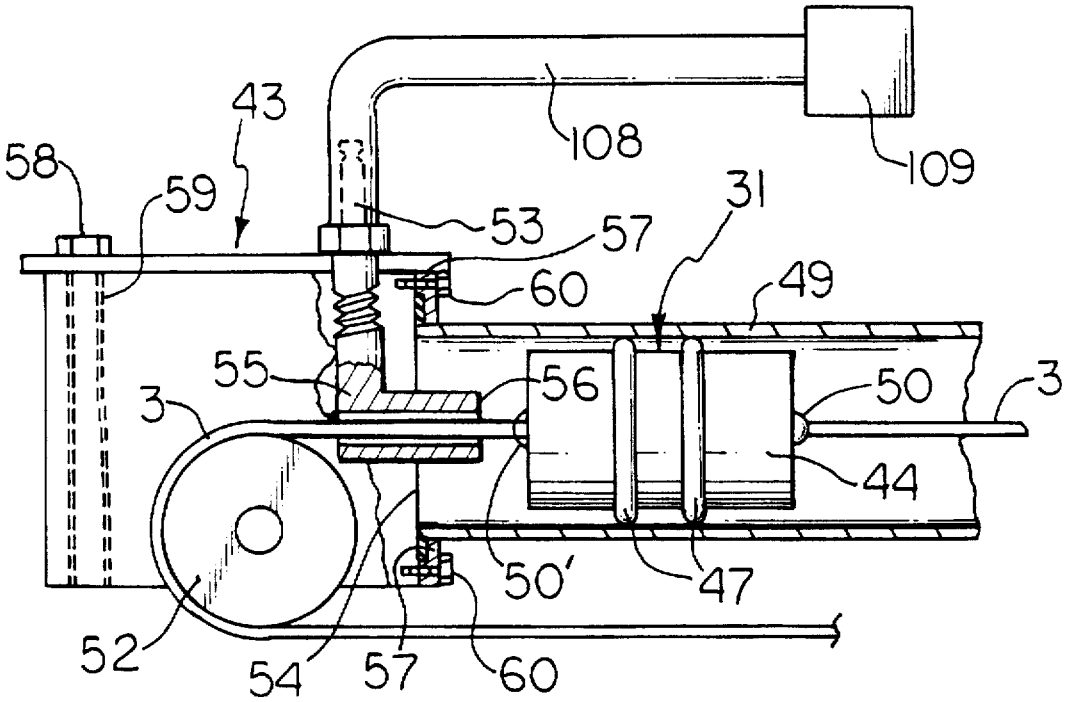
FIG. 5 is an enlarged view of segment 300 of FIG. 1, showing the detail of the piston assembly within the cylinder, and the connections of the drive cables thereto.
Figure 6:
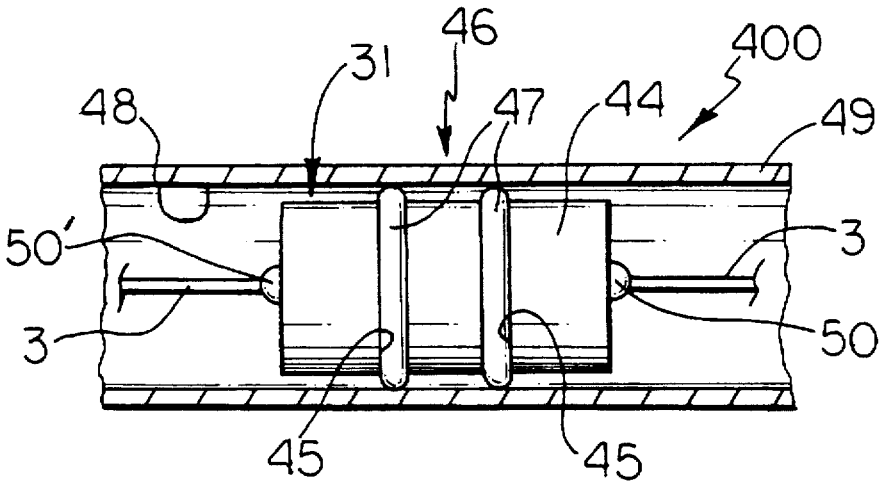
FIG. 6 is an enlarged view of segment 400 of FIG. 1, showing the detail of the piston assembly and the connections of the drive cable thereto.

FIG. 5 is a section, 300, of FIG. 1 which is an enlarged view of one end of the pressure fluid cylinder 2 showing the detail of the piston 31 and a housing 43, while FIG. 6 is a section, 400, of FIG. 1 showing the detail of the piston 31, itself.

Thus, with regard to FIG. 6, the piston assembly 31 is comprised essentially of piston 44, which has two, nearly identical radial grooves 45 in its outer surface and essentially at its center 46. Contained in the radial grooves 45 are two rubber O-rings 47, which contact the inside surface 48, of the cylindrical tube 49, which cylindrical tube 49 forms the carrier for the piston assembly 31. The piston 44 is sized such that it has a slidable contact with the interior surface 48 of the cylindrical tube 49, such that the main contact with such surface is by the O-rings 47, which maintain an air tight seal with the interior surface 48.

The piston assembly 31 has means 50 and 50' for securing the drive cable 3 to the ends 50 and 50' respectively of the piston assembly 31.

Turning now to the detail of FIG. 5 and the end of the pressure fluid cylinder 2, there is showing a housing 43, which contains therein a drive pulley 52 over which the drive cable 3 is driven. Also shown is a pressure inlet 53 (there is an identical housing 43' and pressure inlet 53', in phantom, on the opposite end of the pressure fluid cylinder 2, FIG. 4) and having connected thereto a pressure hose 108, which allows for the ingress and egress of pressurized air or fluid which drives the piston assembly 31. For purposes of this invention, the pressure fluid cylinder 2 is powered by pressurized air or fluid, the source of which is not shown in these Figures, as it is well-known in the art how to supply pressurized air and fluid to such apparatii. Suffice it to say, that a master cylinder 109, not shown in detail herein is used to control the flow of pressurized air or fluid to the inlets 53 and 53' to control the movement of the piston assembly 31.

The inlets 53 and 53' and the end 54 of the cylindrical tube 49 are provided with sealing means 55 and 56, respectively, to contain the air or fluid and force it into the interior of the cylindrical tube 49 to force the piston assembly 31. In addition, there is provided a gasket 57 at the end 54 of the cylindrical tube 49 to enhance this capture and forcing of the air or fluid. The housings 43 and 43' are held together by a series of fasteners 58 (only one of which is shown in phantom), which may be for example, threaded bolts which insert into threaded apertures 59. The cylindrical tube 49 is attached to the housing 43 by similar means as is used to fasten the housings 43 and 43' together and such means are shown at 60 and 60', respectively.

Figure 7:
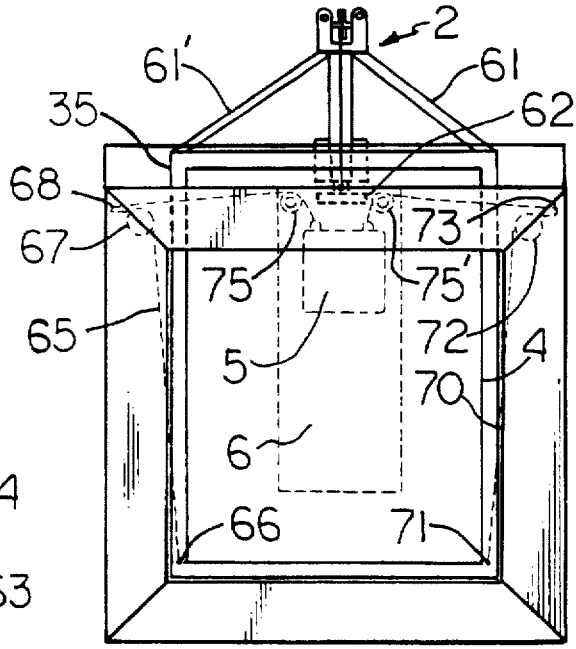
FIG. 7 is a full front view of a fume hood of this invention in which the drive means is vertical and directly attached to the top rail of the moveable sash member.
Figure 8:
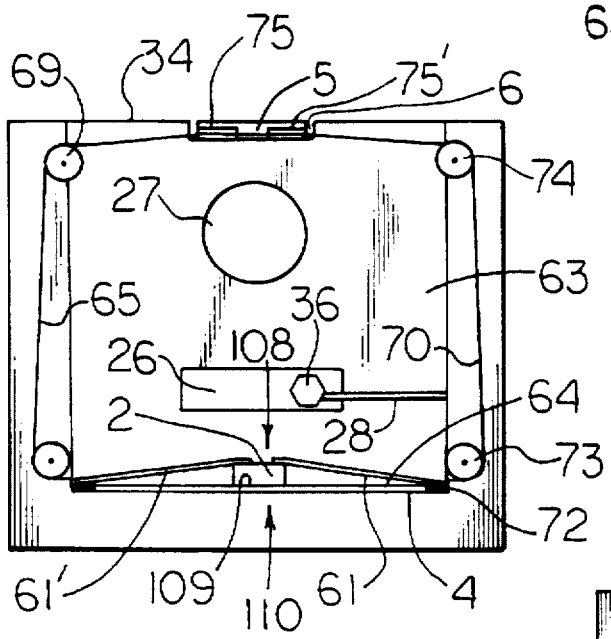
FIG. 8 is a full top view of the fume hood of FIG. 7, showing one configuration of a sash drive cable arrangement for the vertically mounted drive means.

The detailed description following just infra most closely approximates the subject matter of claim 3. Turning now to FIGS. 7 and 8, there is shown in FIGS. 7 and 8 a further drive means, and an alternate cable arrangement, which is yet another embodiment of this invention.

With regard to FIG. 7, there is shown a reduced full front view of the top half of a conventional fume hood 1 which has been modified by this invention in the following manner.

When the occasion arises during the installation of a fume hood 1 of this invention, it may be appropriate to re-locate the pressure fluid cylinder 2 to more closely accommodate the environment and space in which the fume hood 1 is to be used.

Thus, in FIG. 7, there is shown a pressure fluid cylinder 2 which is vertically mounted on the top 63 (FIG. 8) of the fume hood 1. The mounting is shown as consisting of two braces 61 and 61' which run from the pressure fluid cylinder 2 to the side walls 35 of the fume hood 1. In addition, the pressure fluid cylinder 2 is attached by a bracket 62 (in phantom) to the top 63 of the fume hood 1.

It should be noted that the drive bracket 23 is not attached to any cable, but is directly attached to the back side 64 (FIG. 8) of the moveable sash member 4. To assist in the movement of the moveable sash member 4, there is a series of idle cables which are attached to the moveable sash member 4 and which in turn are attached to a dropping dead weight located in either of the side walls 35, or the back wall 34 of the fume hood 1 such that any action by the pressure fluid cylinder 2 to move the moveable sash member 4 causes the idle cables and the dropping dead weight to move simultaneously and thus enable the smooth movement of the moveable sash member 4 in the fume hood 1. Without the assistance of the dropping dead weight, the pressure fluid cylinder 2 cannot overcome the inertia required to begin the movement of the moveable sash member 4, and further, the idle cables assist in maintaining the moveable sash member straight in the fume hood 1 such that it does not tend to bind and hang up on movement.

With regard to both FIG. 7 and 8, there is shown a first idle cable 65 which is attached to the moveable sash member 4 at a point 66 on the left side of the moveable sash member 4. The first idle cable 65 extends upwardly to a first front idler pulley 67 which is horizontally mounted, over the top or outside surface of the first front idler pulley 67 to a second front idler pulley 68 which is mounted vertically on the fume hood 1. All pulleys of this invention are freely rotatable on a center axis. The first idle cable 65 then extends backwardly to a first back idler pulley 69, around the outside of the first back idler pulley 69, and extends to a back dropping dead weight pulley 75, which is horizontally mounted on the back wall 34 of the fume hood 1, and within the dropping dead weight channel 6, near the top 63 of the fume hood 1, whereupon, the idle cable 65 drops downwardly to attach to a dropping dead weight 5 shown in FIG. 8 and in phantom in FIG. 7, at or near the top of the dropping dead weight thereof.

There is also a second idle cable 70 which is also attached to the moveable sash member 4 at a point 71 on the right side of the moveable sash member 4. The second idle cable 70 extends upwardly to a third front idler pulley 72 which is horizontally mounted on the fume hood 1, over the top or outside surface of the third front idler pulley 72 to a fourth front idler pulley 73 which is mounted vertically on the fume hood 1. The second idle cable 70 then extends backwardly to a second back idler pulley 74, around the outside of the second back idler pulley 74, and extends to a back dropping dead weight pulley 75', which is horizontally mounted on the back wall 34 of the fume hood 1, and within the dropping dead weight channel 6, near the top 63 of the fume hood 1, whereupon, the idle cable 70 drops downwardly to attach to a dropping dead weight 5, at or near the top of the dropping dead weight thereof.

The detailed description following just infra approximates the subject matter disclosed in claim 4 of the instant specification.

Figure 9:
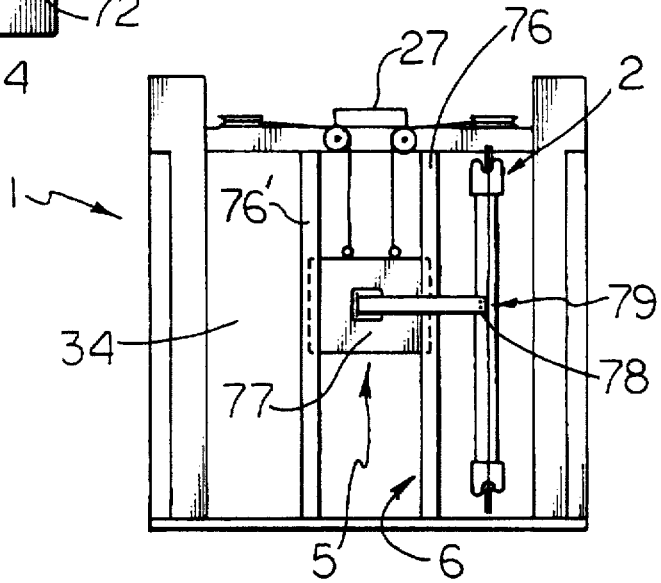
FIG. 9 is a full back view of a fume hood of this invention in which there is shown the direct attachment of the drive means to the dropping dead weight structure within the fume hood and one possible configuration of the cables.
Figure 10:
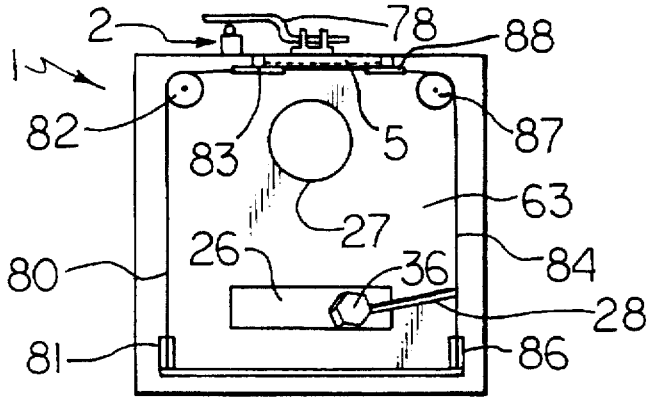
FIG. 10 is a full top view of the fume hood of FIG. 9 showing the sash member cable arrangement.

Turning now to FIGS. 9 and 10, in FIG. 9, there is shown a reduced full back view of a conventional fume hood which has been modified to give the fume hood 1 of this invention and it should be noted that the pressure fluid cylinder 2 is located in the fume hood to attach to and directly drive the dropping dead weight 5.

Taking the two Figures into consideration there is shown a pressure fluid cylinder 2, directly attached to a dropping dead weight 5 within dropping dead weight channel 6, which is formed by two containment channels 76 and 76'. The attachment of the pressure fluid cylinder 2 to the dropping dead weight is made by any convenient attachment means, however, for purposes of illustration herein, the attachment is made by bolting a bracket 78 to the back side 77 of the dropping dead weight 5, and then bolting the opposite end 79 to the drive bracket 23 (not shown here, but is shown in detail on FIG. 4). By this means, whenever the pressure fluid cylinder 2 is activated, the dropping dead weight 5 is directly moved.

Because this mechanism is a direct drive, the pulleys associated with the movement of the moveable sash member 4 are all idle pulleys, that is, they are not driven except by the movement of the cables that pass over them. A slightly different arrangement of the cables and pulleys must be undertaken in this arrangement, as opposed to those found in FIGS. 7 and 8.

Thus, there is shown in FIG. 10 a full top view of the fume hood 1 of FIG. 9 in which the attachments to the lower, inside corners of the moveable sash member 4 are not shown. What is shown is the extension of the left idle cable 80 up and over a horizontally mounted pulley 81, the idle cable 80 extending backwardly to a vertically mounted idle pulley 82, around the outside of the idle pulley 82, and extending to a horizontally mounted dropping dead weight pulley 83, and then extending downwardly to attachment on or near the top of the dropping dead weight 5.

Similarly, the right idle cable 84 extends up and over a horizontally mounted pulley 86, the idle cable 84 extending backwardly to a vertically mounted idle pulley 87, around the outside of the idle pulley 87, and extending to a horizontally mounted dropping dead weight pulley 88, and then extending downwardly to attachment on or near the top of the dropping dead weight 5.

Figure 11:
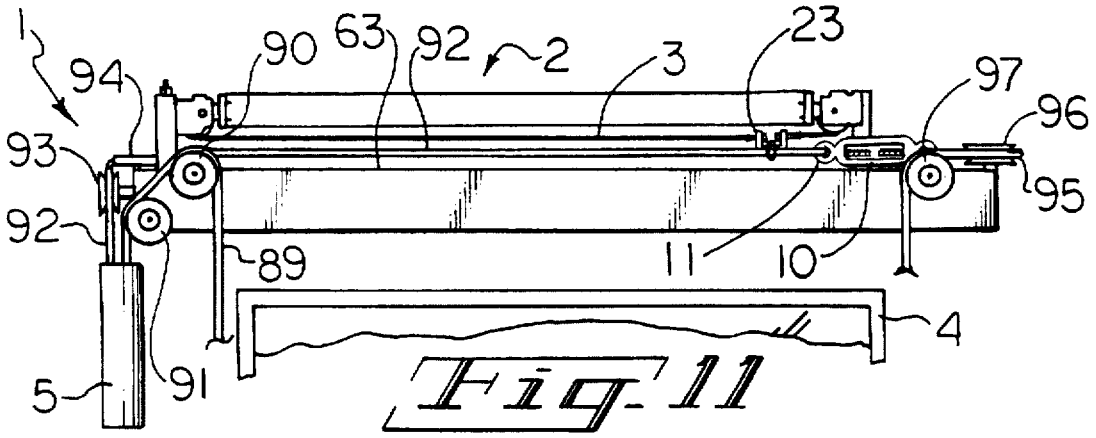
FIG. 11 is a section of the front of a fume hood of this invention illustrating one possible configuration of the sash drive cable and dropping dead weight cable connections and pulley systems.
Figure 12:
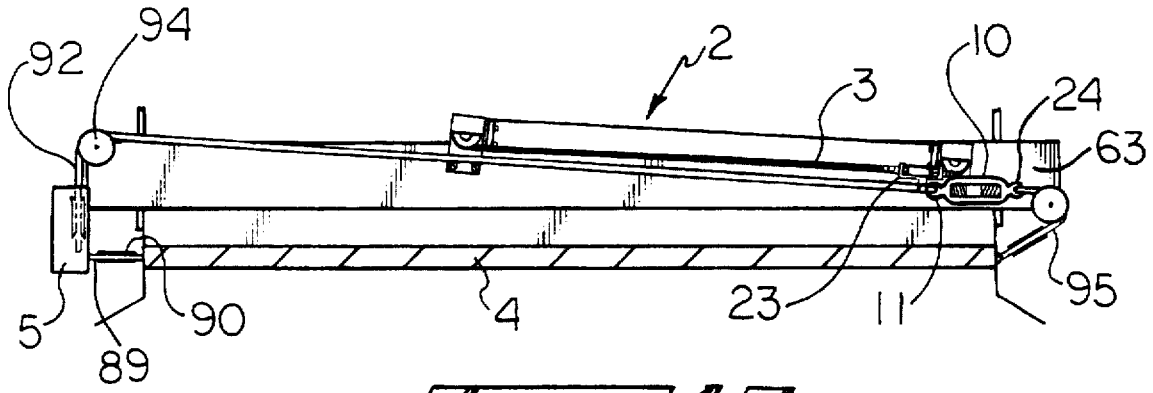
FIG. 12 is a top view of a section of FIG. 11 showing an alternate placement of the drive means and the arrangement of the cables wherein the drive means is laid on its side rather than laying on its bottom as shown in FIG. 11.

With reference to FIGS. 11 and 12, it should be noted that this configuration allows for the mounting of the pressure fluid cylinder near the front of the fume hood, and it should be noted that the pressure fluid cylinder 2 is mounted horizontally, and essentially in the same plane as the fume hood top 63.

Thus, with reference to FIGS. 11 and 12, and specifically beginning with FIG. 11, there is shown a front view of a segment of an upper portion of a fume hood 1, in which there is shown a pressure fluid cylinder 2, mounted essentially horizontally and in the same plane as the fume hood top 63, said fume hood top 63 essentially as shown in FIG. 10.

There is shown a moveable sash member 4. There is a first sash drive cable 89, having an attachment point to the left, lower inside surface of the moveable sash member 4, and which has been amply illustrated supra and it is deemed not necessary to illustrate that attachment point herein. The sash drive cable 89 extends from such attachment point, and up and over a horizontally mounted sash cable pulley 90, and then down and over a second, horizontally mounted sash cable pulley 91, and then extending downwardly to attach to a dropping dead weight 5.

There is a dropping dead weight cable 92 attached at or near the top of the dropping dead weight 5, which dropping dead weight cable 92 extends up and over a horizontally mounted pulley 93, extending around the outside surface of a vertically mounted dropping dead weight pulley 94, and extending essentially across the width of the fume hood 1 to attach to a first ring 11 of a turnbuckle 10. There is a drive bracket 23 which is attached to dropping dead weight cable 92 at or near the turnbuckle ring 11 such that the dropping dead weight cable 92 is attached thereto and is driven by the drive cable 3, which is shown located just above the dropping dead weight cable 92.

On the opposite end 17 of the turnbuckle 10 is another ring 24, to which is attached to a second sash cable 95. The second sash cable 95 extends from the ring 24 to a first sash pulley 96 which is vertically mounted on the top of the fume hood 1. The second sash cable 95 then extends over the top of a second sash pulley 97 and downwardly to attach to the lower right inside surface of the moveable sash member 4.

Thus, with this configuration, when the pressure fluid cylinder 2 is activated, the drive cable 3 is activated along with the drive bracket 23, which drives the cables 92 and 95 simultaneously to move the moveable sash member 4 in the fume hood 1.

FIG. 12 is a top view of the configuration of FIG. 11, in which there is shown a portion of the configuration wherein there is shown cable 92 and 95, dropping dead weight 5, pulley 90, pulley 94, pressure fluid cylinder 2, drive cable 3, ring 11, ring 24, turnbuckle 10, drive bracket 23 and the moveable sash member 4.

Figure 13:
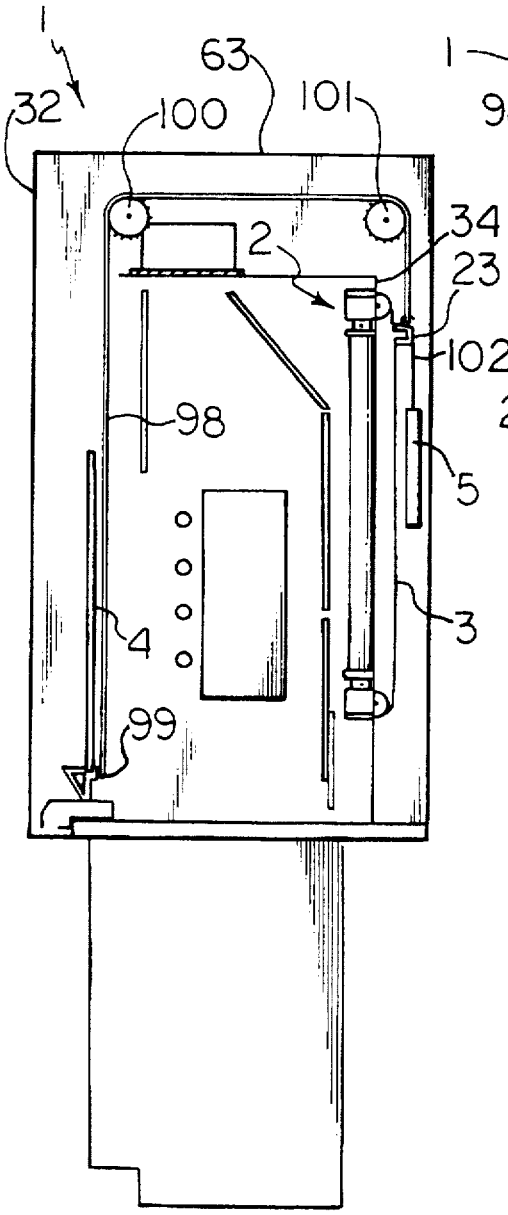
FIG. 13 is a cut-a-way side view of a fume hood of this invention showing the arrangement of the drive chains and the attachment of them to the drive means and the dropping dead weight. This Figure shows the fume hood without the right side attached.
Figure 14:
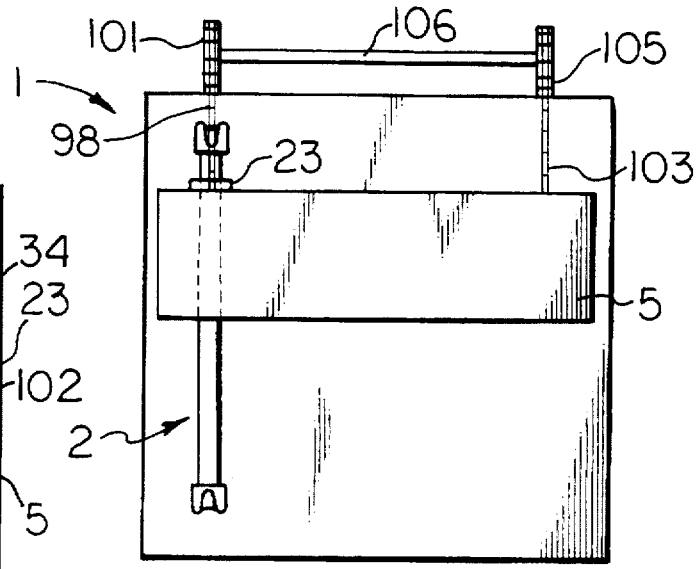
FIG. 14 is a full back view of the fume hood of FIG. 13, showing the vertical arrangement of the drive means and the dropping dead weight.
Figure 15:
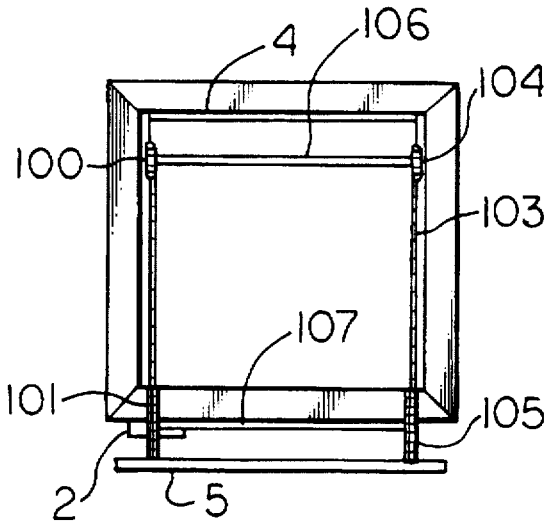
FIG. 15 is a full top view of the fume hood of FIG. 14.

Finally, one last embodiment of this invention is a chain driven configuration, in which the moveable sash member 4 and the dropping dead weight 5 are moved simultaneously by a chain driven mechanism, the details of which can be found below. With reference to FIGS. 13, 14, and 15, there is shown in FIG. 13, a side view of a conventional fume hood which has been modified to give the fume hood 1 of this invention.

FIG. 14 is a full back view of the fume hood of FIG. 13 and FIG. 15 is a full top view of the fume hood of FIG. 13.

FIG. 13 shows a full side view of the fume hood 1 wherein the side wall 35, as well as the fascia, have been removed to show part of the internal mechanism thereof.

There is shown the front 32, back 34, top 63, and the open right side 35 of the fume hood 1 wherein there is shown a moveable sash member 4, a first drive chain 98, which is located inside of the right side wall 35. The first drive chain 98 is attached to the lower, right inside surface of the moveable sash member 4, at point 99. First drive chain 98 extends upwardly to a first chain front drive sprocket 100, over the outside surface of the first chain front drive sprocket 100 and extending backwardly to a first chain back drive sprocket 101, extending over the outside surface of the first chain back drive sprocket 101 and dropping downwardly to a drive bracket 23, which is fixedly attached to a drive cable 3 of the pressure fluid cylinder 2. The pressure fluid cylinder 2 is mounted in a vertical position on the back wall 34 of the fume hood 1, and vertically aligned such that the drive bracket 23 is available for attachment to the first drive chain 98 and moves in essentially a vertical up and down motion as does the first drive chain 98. A further cable 102 is attached to and suspended below the attachment of the first drive chain 98 such that it terminates in attachment to the dropping dead weight 5.

There is a second drive chain 103 (FIG. 15), which is the drive chain for the left side of the mechanism. The second drive chain 103 is attached to the lower, left inside surface of the moveable sash member 4 (not shown) and extends upwardly to a second chain front drive sprocket 104, over the outside surface of the second chain front drive sprocket 104 and extending backwardly to a second chain back drive sprocket 105, extending over the outside surface of the second chain back drive sprocket 105 and dropping downwardly to the dropping dead weight 5 where it is attached.

The first front drive sprocket 100 and the second front drive sprocket 104 are connected by a common axle 106 and thus the sprockets 100 and 104 drive simultaneously.

The first chain back drive sprocket 101 and the second chain back drive sprocket 105 are also connected by a common axle 107 and thus the sprockets 101 and 105 drive simultaneously.

When the pressure fluid cylinder 2 is activated, the drive cable 3 is activated which activates drive bracket 23 whereby the moveable sash 4, and the dropping dead weight 5 are moved simultaneously. Since all of the chain drive sprockets are connected to run essentially simultaneously, the moveable sash member 4 is moved smoothly in an up and down motion within the fume hood 1.

What is claimed is:

1. A trimodal piston driven sash operator for a fume hood structure, said fume hood structure having an access opening in one wall thereof and a closure structure therefor, including a moveable sash member disposed for movement in said access opening to vary the effective size of the opening thereof, said fume hood structure having a top wall, a back wall, and, and idle side wall and a drive side wall, said trimodal piston driven sash operator comprising:

a drive means driven by a power source; said drive means mounted on a stationary portion of the fume hood structure, which drive means is a pressure fluid cylinder, said pressure fluid cylinder comprising in combination;

a pair of housings, one housing being a near end housing and the other housing being a distal end housing, each of said housings having a front wall, a bottom wall, and a top wall, two opposing side walls and a back wall;

an elongated cylinder having a distal end and a near end and a long centered axis and an inside surface bridging said housings and each of the cylinder near end and the distal end being sealed respectively in the front wall of each said housing;

a slidable piston assembly located in said cylinder, said piston assembly having an outside surface, a centered axis parallel with the long centered axis of the cylinder and at least one sealing ring centered around the piston's outside surface to provide a seal between the piston and the inside surface of the cylinder, the piston assembly being slidable along the cylinder when the drive means is activated from the power source;

a first drive cable, said first drive cable being attached to the near end of the piston assembly and at its center axis;

said first drive cable extending along the center axis of the cylinder and extending to and through an opening located in the front surface of the near end housing;

a freely rotatable first housing pulley having a circumferential outside surface, said first housing pulley being mounted on a round axle, said axle being supported on each of its ends by the opposing side walls of said near end housing;

said first drive cable extending along the first housing pulley and around essentially one-half of the circumferential outside surface thereof, said first drive cable extending outside and along the length of the cylinder and connecting with a common drive bracket;

a second drive cable, said second drive cable being attached to the distal end of the piston assembly and at its center axis and extending along the center axis of the cylinder and extending to and through an opening located in the front surface of the distal end housing;

a free rotatable second housing pulley having a circumferential outside surface, said second housing pulley being mounted on a round axle, said axle being supported on each of its ends by the opposing side walls of said near end housing;

said second drive cable extending along the second housing pulley and around essentially one-half of the circumferential outside surface thereof, said second drive cable extending outside and along the length of the cylinder and connecting with the common drive bracket;

each of the said openings in the front surfaces of the housings being sealed around each of the drive cables extending therethrough;

each of the said housings having second openings in the respective front walls thereof, each opening being in communication with a passageway in the housing to allow for the entry of air or fluid to pressure the piston assembly in the cylinder;

the common drive bracket being detachedly fixed to a dead weight structure having a top edge, and located within the fume hood;

means of controlling the power source to control the movement of the dead weight structure, to control movement of the moveable sash member in said access opening.

2. A trimodal piston driven sash operator as claimed in claim 1 wherein the common drive bracket is attached to a first sash drive cable, said first sash drive cable being detachedly fixed to a lower portion of the moveable sash member near a first side wall and extending from the moveable sash member to a freely rotatable, horizontally top mounted first sidewall idler pulley;

said first sash drive cable extending over the first sidewall idler pulley, extending to and around the outside of a vertically top mounted, freely rotatable, second sidewall idler pulley;

said first sash drive cable further extending from said second sidewall idler pulley to a vertically top mounted, freely rotatable, first back idler pulley, said first sash drive cable passing around the outside of the first back idler pulley and terminating and connecting directly to the common drive bracket;

a second sash drive cable, said second sash drive cable being detachedly fixed to a lower portion of the moveable sash member and near a second side wall and extending from the moveable sash member to a freely rotatable, horizontally top mounted third sidewall idler pulley;

said second sash drive cable extending over the third sidewall idler pulley and ex;tending to and around the outside of a freely rotatable, horizontally top mounted wall, fourth idler pulley;

said second sash drive cable extending to a freely rotatable, vertically top mounted second back idler pulley, said second sash drive cable passing around the outside of the second back idler pulley and extending to a first dead weight pulley mounted on a back wall of the fume hood and passing around the outside of the dead weight pulley and extending to and connecting with the dead weight;

a dead weight drive cable connected to the dead weight at or near the top of the dead weight, said dead weight drive cable extending upwardly to a second dead weight pulley vertically mounted on the back wall of the fume hood and passing around the outside of the dropping dead weight pulley, said dead weight cable extending to and connecting with the common drive bracket;

means of controlling the drive means to control the movement of the first and second sash drive cables to control the movement of the sash in said access opening.

3. A trimodal piston driven sash operator as claimed in claim 1 wherein, the common drive bracket is attached to said drive means by a suitable means and said common drive bracket is detachedly fixed to the top rail of the moveable sash member.

4. A trimodal piston driven sash operator as claimed in claim 1 wherein said drive means is mounted vertically on a stationary portion of the fume hood structure.

5. A trimodal piston driven sash operator for a fume hood structure, said fume hood structure having an access opening in one wall thereof and a closure structure therefor, including a moveable sash member disposed for movement in said access opening to vary the effective size of the opening thereof, said moveable sash member having a top rail and a bottom rail, comprising:

a drive means driven by a power source; said drive means being vertically mounted on a stationary portion of the fume hood structure, which drive means is a pressure fluid cylinder, said pressure fluid cylinder comprising in combination;

a pair of housings, one housing being a near end housing and the other housing being a distal end housing, each of said housings having a front wall, a bottom wall, a top wall, two side walls and a back wall;

an elongated cylinder having a distal end and a near end and a long centered axis and an inside surface bridging said housings and each of the cylinder near end and distal end being sealed respectively in each said housing;

a slidable piston assembly located in said cylinder, said piston assembly having an outside surface, a centered axis parallel with the long centered axis of the cylinder and at least one sealing ring centered around the pistons outside surface to provide an air seal between the piston and the inside surface of the cylinder, the piston assembly being slidable along the cylinder when the drive means is activated from the power source;

first drive cable, said first drive cable being attached to the near end of the piston assembly and at its center axis;

said first drive cable extending along the center axis of the cylinder and extending to and through an opening located in the front surface of the near end housing;

a freely rotatable first housing pulley having a circumferential outside surface, said first housing pulley being mounted on a round axle, said axle being supported on each of its ends by the opposing side walls of said near end housing;

said first drive cable extending along the first housing pulley and around essentially one-half of the circumferential outside surface thereof, said first drive cable extending outside and along the length of the cylinder and connecting with a common drive bracket;

a second drive cable, said second drive cable being attached to the distal end of the piston assembly and at its center axis and extending along the center axis of the cylinder and extending to and through an opening located in the front surface of the distal end housing;

a freely rotatable second housing pulley having a circumferential outside surface, said second housing pulley being mounted on a round axle, said axle being supported on each of its ends by the opposing side walls of said near end housing;

said second drive cable extending along the second drive pulley and around essentially one-half of the circumferential outside surface thereof, said second drive cable extending outside and along the length of the cylinder and connecting with the common drive bracket;

each of the said openings in the front surfaces of the housings being sealed around each of the cables extending therethrough;

each of the said housings having second openings in the respective front walls thereof, each opening being in communication with a passageway in the housing to allow for the entry of air to pressure the piston assembly in the cylinder;

the common drive bracket being attached to said drive means by a suitable means and said common drive bracket being detachedly fixed to a common weight structure within the hood;

a freely rotatable first drive axle having a near end and a distal end, said first drive axle being mounted on the top of the fume hood structure and near and parallel with the top rail of the moveable sash member;

a freely rotatable second drive axle having a near end and a distal end and being mounted on the top of the fume hood structure and distal to the moveable sash member and near the back of the fume hood structure, said second drive axle being aligned essentially parallel with the first drive axle;

a first driveable chain being attached to the moveable sash member at or near the bottom rail and extending from the moveable sash member to a first chain sprocket, said first chain sprocket being mounted on the near end of the first drive axle, said first drive chain extending over the first chain sprocket and extending to and around the outside of a second chain sprocket, said second chain sprocket being mounted on the near end of the freely rotatable second drive axle, said first chain passing to the common weight structure and being detachedly fixed thereto;

a second driveable chain being attached to the moveable sash member at or near the bottom rail and extending from the moveable sash member to a third chain sprocket, said third chain sprocket being mounted on the distal end of the first drive axle, said second drive chain extending from the bottom rail of the moveable sash member and over the third chain sprocket, extending to and around the outside of a fourth chain sprocket, said fourth chain sprocket being mounted on the distal end of the freely rotatable second drive axle, said second chain passing to the common weight structure and being detachedly fixed thereto;

means of controlling the power source to control the movement of the weighted structure, to control movement of the moveable sash member in said access opening.

6. A fume hood, including a trimodal piston drive sash operator, said fume hood having an access opening in one wall thereof and a closure structure therefor, including a moveable sash member disposed for movement in said access opening to vary the effective size of the opening thereof, said fume hood structure having a top wall, a back wall, an idle side wall and a drive side wall, said trimodal piston driven sash operator comprising:

a drive means driven by a power source; said drive means mounted on a stationary portion of the fume hood structure, which drive means is a pressure fluid cylinder, said pressure fluid cylinder comprising in combination;

a pair of housings, one housing being a near end housing and the other housing being a distal end housing, each of said housings having a front wall, a bottom wall, and a top wall, two opposing side walls and a back wall;

a elongated cylinder having a distal end and a near end and a long centered axis and an inside surface bridging said housings and each of the cylinder near end and distal end being sealed respectively in the front wall of each said housing;

a slidable piston assembly locate din said cylinder, said piston assembly having an outside surface, a centered axis parallel with the long centered axis of the cylinder and at least one sealing ring centered around the piston's outside surface to provide a seal between the piston and the inside surface of the cylinder, the piston assembly being slidable along the cylinder when the drive means is activated from the power source;

a first drive cable, said first drive cable being attached to the near end of the piston assembly and at its center axis;

said first drive cable extending along the center axis of the cylinder and extending to and through an opening located in the front surface of the near end housing;

a freely rotatable first housing pulley having a circumferential outside surface, said first housing pulley being mounted on a round axle, said axle being supported on each of its ends by the opposing side walls of said near end housing;

said first drive cable extending along the first housing pulley and around essentially one-half of the circumferential outside surface thereof, said first drive cable extending outside and along the length of the cylinder and connecting with a common drive bracket;

the said common drive bracket being attached to a first sash drive cable, said first sash drive cable being detachedly fixed to a lower portion of the moveable sash member near a first side wall and extending from the moveable sash member to a freely rotatable, horizontally top mounted first sidewall idler pulley;

said first sash drive cable extending over the first sidewall idler pulley, extending to and around the outside of a vertically top mounted, freely rotatable, second sidewall idler pulley;

said first sash drive cable further extending from said second sidewall idler pulley to a vertically top mounted, freely rotatable, first back idler pulley, said first sash drive cable passing around the outside of the first back idler pulley and terminating and connecting directly to the common drive bracket;

a second sash drive cable, said second sash drive cable being detachedly fixed to a lower portion of the moveable sash member and near a second side wall and extending from the moveable sash member to a freely rotatable, horizontally top mounted third sidewall idler pulley;

said second sash drive cable extending over the third sidewall idler pulley and extending to and around the outside of a freely rotatable, horizontally top mounted wall, fourth idler pulley;

said second sash drive cable extending to a freely rotatable, vertically top mounted second back idler pulley, said second sash drive cable passing around the outside of the second back idler pulley and extending to a first dead weight pulley mounted on a back wall of the fume hood and passing around the outside of the dead weight pulley and extending to and connecting with the dead weight;

a dead weight drive cable connected to the dead weight at or near the top of the dead weight, said dead weight drive cable extending upwardly to a second dead weight pulley vertically mounted on the back wall of the fume hood and passing around the outside of the dropping dead weight pulley, said dead weight cable extending to and connecting with the common drive bracket;

means of controlling the drive means to control the movement of the first and second sash drive cables to control the movement of the sash in said access opening.

7. A fume hood structure, including a drive means for a sash, said fume hood having an access opening in one wall thereof and a closure structure therefor, including a moveable sash member disposed for movement in said access opening to vary the effective size of the opening thereof, said moveable sash member having a top rail and a bottom rail, comprising:

a drive means driven by a power source; said drive means being vertically mounted on a stationary portion of the fume hod structure, which drive means is a pressure fluid cylinder, said pressure fluid cylinder comprising in combination;

a pair of housings, one housing being a near end housing and the other housing being a distal end housing, each of said housings having a front wall, a bottom wall, a top wall, two side walls and a back wall;

an elongated cylinder having a distal end and a near end and a long centered axis and an inside surface bridging said housings and each of the cylinder near end and distal end being sealed respectively in each said housing;

a slidable piston assembly located in said cylinder, said piston assembly having an outside surface, a centered axis parallel with the long centered axis of the cylinder and at least one sealing ring centered around the pistons outside surface to provide an air seal between the piston and the inside surface of the cylinder, the piston assembly being slidable along the cylinder when the drive means is activated from the power source;

a first drive cable, said first drive cable being attached to the near end of the piston assembly and at its center axis;

said first drive cable extending along the center axis of the cylinder and extending to and through an opening located in the front surface of the near end housing;

a freely rotatable first housing pulley having a circumferential outside surface, said first housing pulley being mounted on a round axle, said axle being supported on each of its ends by the opposing side walls of said near end housing;

said first drive cable extending along the first housing pulley and around essentially one-half of the circumferential outside surface thereof, said first drive cable extending outside and along the length of the cylinder and connecting with a common drive bracket;

a second drive cable, said second drive cable being attached to the distal end of the piston assembly and at its center axis and extending along the center axis of the cylinder and extending to and through an opening located in the front surface of the distal end housing;

a freely rotatable second housing pulley having a circumferential outside surface, said second housing pulley being mounted on a round axle, said axle being supported on each of its ends by the opposing side walls of said near end housing;

said second drive cable extending along the second drive pulley and around essentially one-half of the circumferential outside surface thereof, said second drive cable extending outside and along the length of the cylinder and connecting with the common drive bracket;

each of the said openings in the front surfaces of the housings being sealed around each of the cables extending therethrough;

each of the said housings having second openings in the respective front walls thereof, each opening being in communication with a passageway in the housing to allow for the entry of air to pressure the piston assembly in the cylinder;

the common drive bracket being attached to said drive means by a suitable means and said common drive bracket being detachedly fixed to a common weight structure within the hood;

a freely rotatable first drive axle having a near end and a distal end, said first drive axle being mounted on the top of the fume hood structure and near and parallel with the top rail of the moveable sash member;

a freely rotatable second drive axle having a near end and a distal end and being mounted on the top of the fume hood structure and distal to the moveable sash member and near the back of the fume hood structure, said second drive axle being aligned essentially parallel with the first drive axle;

a first driveable chain being attached to the moveable sash member at or near the bottom rail and extending from the moveable sash member to a first chain sprocket, said first chain sprocket being mounted on the near end of the first drive axle, said first drive chain extending over the first chain sprocket and extending to and around the outside of a second chain sprocket, said second chain sprocket being mounted on the near end of the freely rotatable second drive axle, said first chain passing to the common weight structure and being detachedly fixed thereto;

a second driveable chain being attached to the moveable sash member at or near the bottom rail and extending from the moveable sash member to a third chain sprocket, said third chain sprocket being mounted on the distal end of the first drive axle, said second drive chain extending from the bottom rail of the moveable sash member and over the third chain sprocket, extending to and around the outside of a fourth chain sprocket, said fourth chain sprocket being mounted on the distal end of the freely rotatable second drive axle, said second chain passing to the common weight structure and being detachedly fixed thereto;

means of controlling the power source to control the movement of the weighted structure, to control movement of the moveable sash member in said access opening.

* * * * *